United States Patent [19]

Watanabe et al.

[11] Patent Number: 4,478,550

[45] Date of Patent: Oct. 23, 1984

[54] PUMP APPARATUS

[75] Inventors: Kiyohiko Watanabe, Chiryu; Kazuma Matsui, Toyohashi; Yoshiyuki Hattori, Toyoake; Toshihiro Takei, Kariya; Toshiaki Nakamura, Anjo; Shunsaku Ohnishi, Toyota, all of Japan

[73] Assignee: Nippondenso Co., Ltd., Kariya, Japan

[21] Appl. No.: 370,350

[22] Filed: Apr. 21, 1982

[30] Foreign Application Priority Data

Apr. 22, 1981 [JP] Japan ..... 56-58105[U]

[51] Int. Cl.[3] ..... F04D 5/00

[52] U.S. Cl. ..... 415/53 T; 415/213 T

[58] Field of Search ..... 415/53 T, 213 T, 198.2

[56] References Cited

U.S. PATENT DOCUMENTS 1,865,396 6/1932 Claypool ..... 415/213 T
3,658,444 3/1972 Rhodes et al. ..... 415/213 T

FOREIGN PATENT DOCUMENTS 1037860 8/1958 Fed. Rep. of Germany .... 415/53 T
1062882 8/1959 Fed. Rep. of Germany ... 415/213 T

*Primary Examiner*—Philip R. Coe
*Assistant Examiner*—Arthur D. Dahlberg
*Attorney, Agent, or Firm*—Cushman, Darby & Cushman

[57] ABSTRACT

A pump apparatus has a regenerative pump and a motor for driving the regenerative pump. A substantially annular flow passage is formed in the pump housing of the regenerative pump and communicated with a discharge port and a suction port. An impeller is rotatably housed in the pump housing. A plurality of radial vane grooves are formed circumferentially spaced in the outer peripheral portion of each surface of the impeller. A recess is formed in the portion of one of side surfaces of the flow passage aligned axially with the discharge port formed in the other side face of the flow passage.

2 Claims, 7 Drawing Figures

PUMP APPARATUS

BACKGROUND OF THE INVENTION

1. Field of the Invention

The present invention relates to a pump apparatus such as a fuel pump for forcedly delivering fuel from a tank into an internal combustion engine mounted on a vehicle.

2. Description of the Prior Art

In the field of pumps of the class specified above, various types of pumps have been used, such as displacement type pump (for example, roller pump), centrifugal type pump (for example, axial flow pump), and regenerative pump of open vane type. The displacement type pumps, such as roller pump, are operative to produce a high pressure of about 2 to 3 Kg/cm$^2$ and provide a high efficiency. The pumps of this type, however, must be manufactured with a high precision and, hence, are generally expensive. The pumps of this type, moreover, produce noise and vibration and, in addition, pulsated discharge pressure. With the pumps of centrifugal type, it is difficult to obtain a high discharge pressure of 2 to 3 Kg/cm$^2$. The regenerative pump of open vane type also are not capable of producing a high discharge pressure of 2 to 3 Kg/cm$^2$, and can operate only at a low efficiency. In addition, this "open vane type pump" often faces restrictions of installation space. Due to this restriction, it is not allowed to provide the discharge port in the peripheral wall of the pump housing. Consequently, the discharge port has to be provided in one end wall of the pump housing. As a result, a thrust is imparted to the impeller for a reason which will be detailed later with reference to the drawings, so that the impeller is undesirably biased to contact the inner surface of the pump housing. In consequence, the efficiency of the pump is lowered and the life of the same is shortened unfavourably. The term "regenerative pump of open vane type" means a regenerative pump in which the bottom face of each of vane grooves formed in one of end faces of a disc-like impeller intersects with the bottom face of an adjacent vane groove formed in the other end face of the impeller. In contrast to this, by the term "regenerative pump of closed vane type" to be used in hereinafter it is intended to mean a regenerative pump in which the bottom face of each of vane grooves formed in one of the end faces of a disc-like impeller does not intersect with the bottom face of an adjacent vane groove formed in the other end face of the impeller.

SUMMARY OF THE INVENTION

Accordingly, an object of the invention is to provide a highly durable pump apparatus operable at reduced levels of noise, vibration and pulsation, while achieving a high discharge pressure of 2 to 3 Kg/cm$^2$ and a high pump efficiency.

To this end, the pump apparatus of the present invention employs a regenerative pump of closed vane type which inherently can produce a high discharge pressure of 2 to 3 Kg/cm$^2$ and be operable at high efficiency and with low levels of vibration, pulsation and noise. In addition, according to the invention, a recess is formed in a portion of one side surface of a flow passage formed in the pump opposing to the other side surface in which a discharge port is provided. More specifically, the recess is formed in the portion of radially outer of the peripheral surface of a impeller surrounded by the flow passage. According to this arrangement, the thrust force acting on the impeller is eliminated to keep the impeller out of contact with the side surfaces of the flow passage, thereby to ensure a high pump efficiency and durability.

DESCRIPTION OF THE PREFERRED EMBODIMENTS

By way of example, an electrically operated fuel pump embodying the present invention will be described hereinunder with reference to the accompanying drawings.

Figure 1:
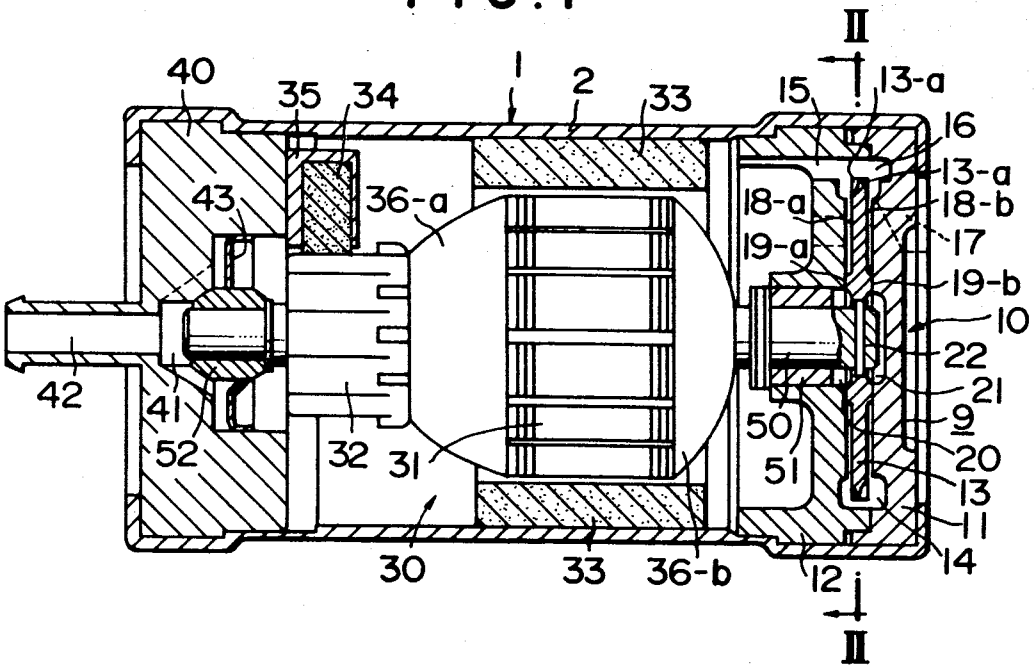
FIG. 1 is a longitudinal sectional view of a pump apparatus in accordance with an embodiment of the invention, taken along the line I—I of FIG. 2.
Figure 2:
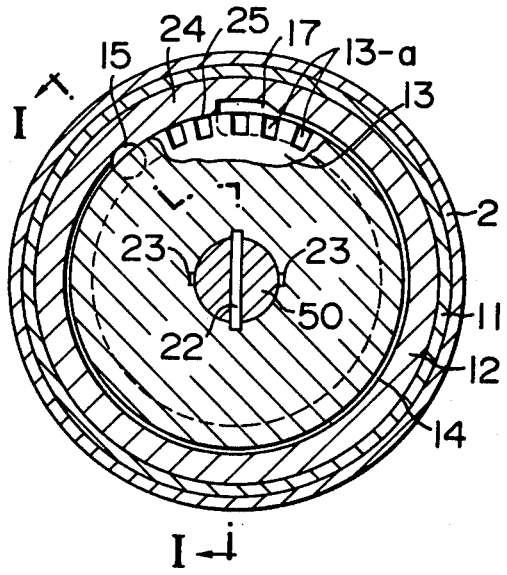
FIG. 2 is a sectional view taken along the line II—II of FIG. 1.

Referring to FIGS. 1 and 2, a pump apparatus generally designated at a reference numeral 1 has a casing 2 which accommodates therein a pump 10 and a motor means 30. The pump 10 has a substantially disc-like impeller 13 rotatably housed in a pump housing 9 composed of an inlet housing part 11 and an outlet housing part 12 both of which are secured to the inner peripheral surface of the casing 2. The inlet housing part 11 and the outlet housing part 12 are provided with a suction port 17 and a discharge port 15, respectively. The outlet housing part 12 serves also as a holder for a first bearing 51 which carries one end of the shaft 50 rotatably.

The impeller 13 is mounted on the shaft 50 axially slidably. The transmission of the torque from the shaft 50 to the impeller 13 is made through a pin 22 fitted in a hole formed in the shaft 50. A plurality of radial vane grooves **13-*a* are formed at circumferential spaced each other in the outer peripheral portion of each end surface of the impeller 13 to form a vane groove row. A substantially annular flow passage 14 is defined in the pump by the impeller 13 and both housing parts 11, 12. This flow passage communicates with the aforementioned suction port 17 and the discharge port 15. As will be clearly seen from FIG. 2, the suction port 17 and the discharge port 15 are circumferentially spaced each other. The flow passage 14 is circumferentially interrupted by the presence of a partition wall 24**.

A plurality of pressure-conducting grooves 23 are formed in the inner peripheral surface of the shaft bore formed in the impeller 13, to achieve a balance of pressure between pump chambers 20 and 21 defined at opposite sides of the impeller 13. The gaps between respective housing parts and the opposite surfaces of the impeller are sealed by a first sealing section **18-*a*, 18-*b* and a second sealing section 19-*a*, 19-*b* disposed radially inwardly of the first sealing section as illustrated. These sealing sections effectively prevents the flow passage 14 from being communicated with the pump chambers 20 and 21. More specifically, the side clearance or gap defined by the end surfaces of the impeller and inner side surfaces of the housing parts 11 and 12 in the second sealing section 19**-*a*, 19-*b* is smaller than that in the first sealing section 18-*a*, 18-*b*. Thus, the second sealing section controls the side clearance in the first section and prevents any damaging of the outer peripheral edges of the impeller due to offset of the impeller. A third sealing portion 25 is provided between the outer peripheral surface of the impeller 13 and the partition wall 24, to effectively prevents the leak of the fuel pressure from the discharge port 15 into the suction port 17.

Figure 3:
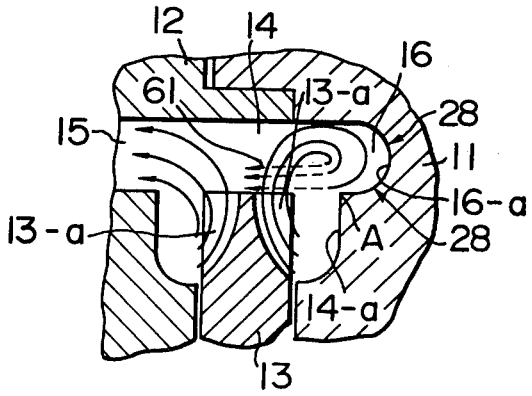
FIG. 3 is a fragmentary enlarged sectional view of a portion of the pump apparatus shown in FIG. 1 around a discharge port.

As will be seen from FIG. 3, a recess 16 is formed in a portion of one side surface 14*a* of the flow passage 14 aligning axially with the discharge port 15 formed in the other side surface opposing to the one side surface 14-*a*. The tangential line from the wall surface 16-*a* of the recess 16 at a point A (at which the side surface 14-*a* of the flow passage 14 intersects the surface 16-*a* of the recess 16) extends into the discharge port without intersecting the impeller 13. In order to obtain a smooth flow of the fuel, the corners 28 of the bottom of the recess 16 are rounded.

A description will be made hereinunder as to the motor 30. Referring again to FIG. 1, the motor 30 has a permanent magnet 33 fixed to the inner surface of the casing 2. An armature 31 is mounted on a portion of the shaft 50 opposing to the permanent magnet 33. A commutator 32 is mounted on a portion of the shaft 50 adjacent to the armature 31. Bowl-shaped capsules 36-*a* and 36-*b* are attached to both ends of the armature 31, in order to decrease the fluid friction resistance encountered by the fuel when the motor is operated.

An end wall or a bearing holder 40 is secured to the inner surface of the casing 2. The bearing holder 40 is provided with a discharge passage 41 and a discharge port 42 communicating with each other. The bearing holder 40 supports brush holders 35 holding brushes 34 and cooperates with a lock washer 43 to support a second bearing 52. The bearing 52 carries the other end of the shaft 50.

The fuel pump apparatus having the described construction operates in a manner explained hereinunder. The armature 31 rotates together with the impeller 13 as an electric power is supplied to the armature through the brushes and the commutator 32. In consequence, the fuel is sucked through the suction port 17 and is pressurized to a pressure of 2 to 3 $Kg/cm^2$ as it flows circumferentially along the flow passage 14. The fuel is then discharged into the space in the motor 30 through the discharge port 15. The pressurized fuel effectively cools the armature 31 as it flows through the gap between the armature 31 and the permanent magnet 33, and is finally discharged from the discharge port 42 through the discharge passage 41.

Figure 4:
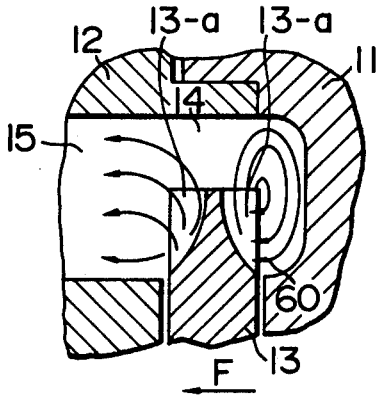
FIG. 4 is a fragmentary enlarged sectional view of a portion of a conventional regenerative pump around the discharge port.

FIGS. 3 and 4 show the stream lines of a fuel in the area around discharge ports 15 in the pump apparatus of the invention and in a prior art pump, respectively. Namely, FIG. 4 illustrates the stream lines of the fuel in the conventional pump having no recess and the discharge port positioned at the radially inwardly of the outer peripheral edge of the impeller 13. As will be seen from FIG. 4, eddy currents 60 exist in a vane groove formed in one end surface of the impeller 13 opposing to the end surface having the discharge port 15, i.e. in the right end surface. However, no eddy current exists in a vane groove formed in the other end surface of the impeller and facing toward the discharge port 15, i.e. in the left end surface. In consequence, a resultant thrust is applied to the impeller as the sum of the force component F produced by the eddy currents 60 colliding against the impeller 30 and the force due to a pressure rise in the right side vane grooves caused by the presence of the eddy currents 60. This resultant thrust urges the impeller to the left as viewed in the drawings to make the same contact with the housing to lower the efficiency and to shorten the life of the pump. In contrast to the above, in the pump apparatus of the invention shown in FIG. 3, there is no eddy currents 60 but the fuel flows smoothly as represented by arrows 61 into the discharge port 15 while being guided by the wall surface 16-*a* of the recess 16, without colliding with the impeller 13. In the described embodiment, the discharge port 15 is formed at a position radially outwardly of the outer periphery of the impeller, so that the flow passage 14 can be constructed in symmetry with respect to the impeller thereby to eliminate any unbalance of pressure in opposite sides of the impeller. In consequence, the undesirable contact of the impeller due to offset of the same is avoided advantageously.

Figure 5:
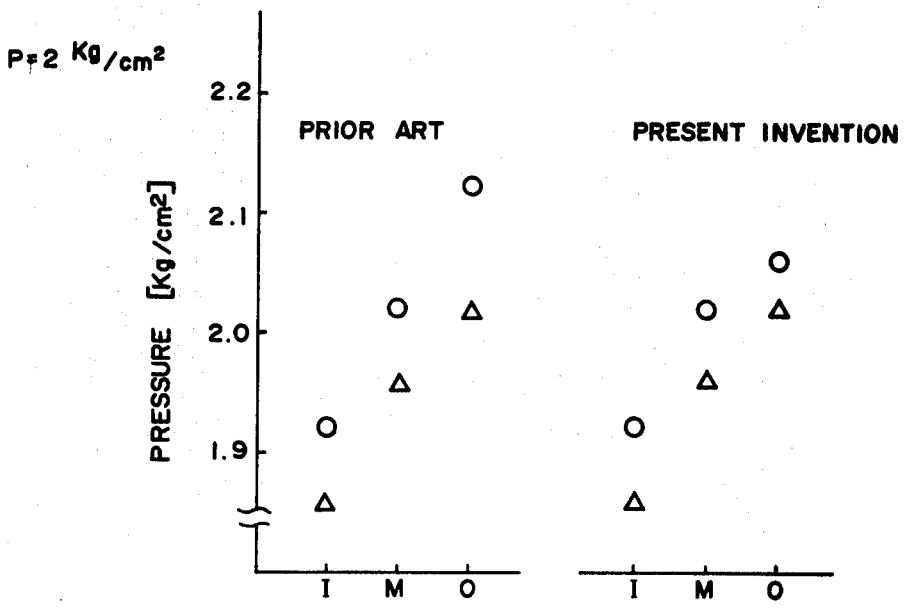
FIGS. 5 and 6 are illustrations of the results of a test conducted in comparison with the pump apparatus of the invention and the conventional pump.
Figure 6:
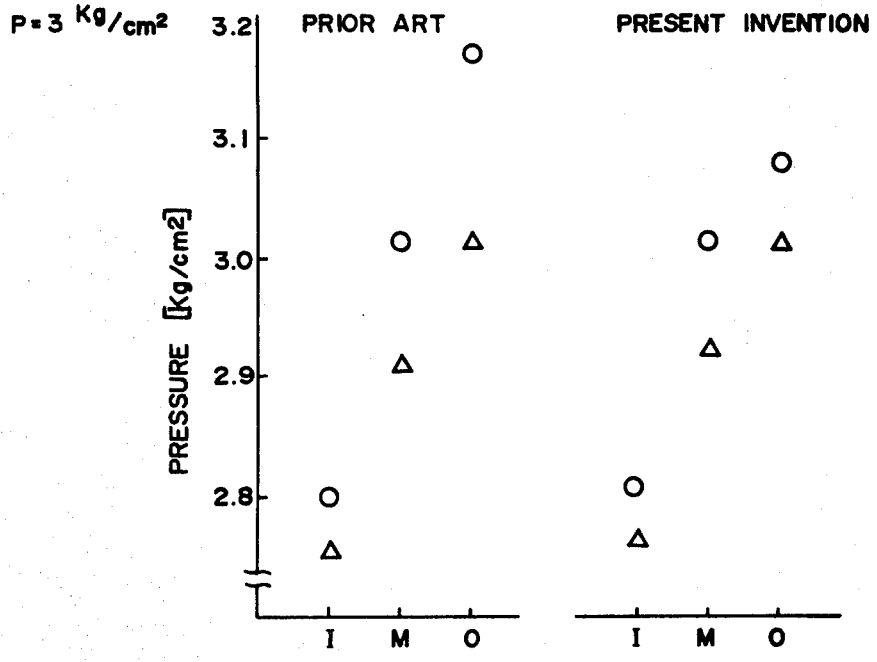
Figure 7:
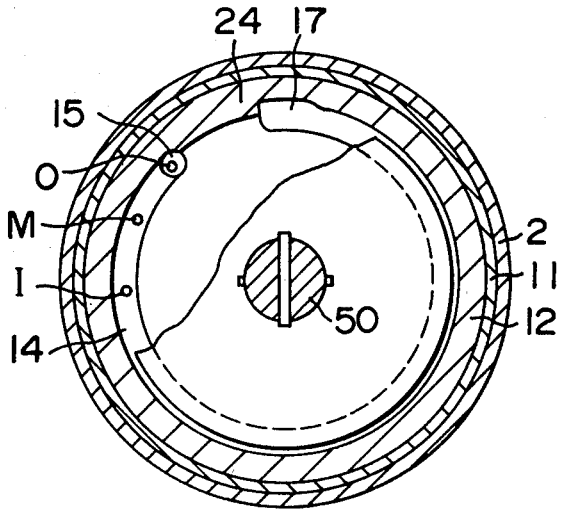
FIG. 7 is an illustration of positions of measurement points employed in the test shown in FIGS. 5 and 6.

Hereinunder, an explanation will be made as to the result of tests conducted by the inventors of the present application to confirm the advantage of the invention, with specific reference to FIGS. 5 to 7. FIG. 7 illustrates the points O, M and I, where fuel pressures are measured, in the area of the flow passage 14 around the discharge port 15. At each of the portions, the pressures of a portion adjacent to the inlet housing part 11 and a portion adjacent to the outlet housing part 12 are measured and the result of which is shown in FIGS. 5 and 6, respectively. More specifically, FIG. 5 shows the results as obtained when the pump discharge pressure is 2 $Kg/cm^2$, while FIG. 6 shows the results as obtained when the pump discharge pressure is 3 $Kg/cm^2$. In these Figures, the pressures measured at portions adjacent to the outlet housing part are marked at Δ, while the pressures measured at portions adjacent to the inlet housing part are represented by a mark o. From these Figures, it will be seen that the pressure difference at the point O between at the portions adjacent to the inlet housing part and adjacent to the outlet housing part in the pump apparatus of the invention is considerably smaller than that in the prior art pump apparatus. This means that the thrust applied to the impeller in the pump apparatus of the invention is much smaller than that in the prior art pump apparatus.

As has been described, according to the invention, it is possible to produce a high discharge pressure of 2 to 3 $Kg/cm^2$ and be operable at a high efficiency well reaching 20 to 30% by means of the use of a regenerative pump of closed vane type. For the same reason, the unfavourable pulsation, vibration and the noise are remarkably suppressed as compared with the conventional displacement type high-pressure pump such as roller pump. Furthermore, the thrust applied to the impeller is largely decreased and the balance of pressure across the impeller is obtained to completely keep the impeller out of contact with the housing, thereby to further improve the efficiency and the durability of the pump.

Although the pump apparatus of the invention has been described as an electrically operated fuel pump, it will be clear to those skilled in the art that the invention can broadly apply to various types of pump which deliver fluid.

What is claimed is:

1. A pump apparatus comprising:

a regenerative pump means;

said regenerative pump means including a pump housing and a closed vane type impeller rotatably housed in said pump housing, said impeller being substantially disc-like shaped and provided with a plurality of radial vane grooves formed in portions of opposite end faces of said impeller adjacent to the outer peripheral surface thereof and spaced in the circumferential direction relative to each other, said pump housing cooperating with said impeller to define a substantial annular fluid passage surrounding said radial vane grooves, said pump housing being provided therein with suction and discharge ports, said discharge port being communicated with said annular fluid passage through a portion of one side surface thereof, and a recess provided in a portion of the other side surface of said annular fluid passage opposing to said discharge port, said recess being so disposed that a radial innermost side wall portion thereof is located radially outward of said outer peripheral surface of said impeller.

2. A pump apparatus according to claim 1, wherein said discharge port is aligned with said recess in the axial direction, and wherein said recess has a sectional shape so that the tangential line of the bottom face of said recess extends, from the point in which the bottom face of said recess intersects the side surface of said annular fluid passage, into said discharge port without colliding with said impeller, and wherein said discharge port is so disposed that a radial outermost opening portion of said discharge port is located radially outward of said outer peripheral surface of said impeller and that a radial innermost opening portion of said discharge port is located radially inward of said outer peripheral surface of said impeller.

* * * * *